US005598713A

United States Patent [19]

Bartilucci

[11] Patent Number: 5,598,713

[45] Date of Patent: Feb. 4, 1997

[54] PORTABLE SELF-CONTAINED COOLER/FREEZER APPARATUS WITH NITROGEN ENVIRONMENT CONTAINER

[75] Inventor: Anthony R. Bartilucci, Wantagh, N.Y.

[73] Assignee: Grumman Corporation, Los Angeles, Calif.

[21] Appl. No.: 347,700

[22] Filed: Dec. 1, 1994

[51] Int. Cl.[6] ..... F24F 3/16

[52] U.S. Cl. ..... 62/78; 62/384; 62/457.9

[58] Field of Search ..... 62/78, 384, 388, 62/457.9

[56] References Cited

U.S. PATENT DOCUMENTS

| | | | |
|---|---|---|---|
| 3,163,022 | 12/1964 | Hottenroth | 62/388 |
| 4,825,666 | 5/1989 | Saia, III | 62/384 |
| 4,991,402 | 2/1991 | Saia, III | 62/52.1 |
| 5,125,237 | 6/1992 | Saia, III et al. | 62/239 |

*Primary Examiner*—Ronald C. Capossela
*Attorney, Agent, or Firm*—Terry J. Anderson; Karl J. Hoch, Jr.

[57] ABSTRACT

A self-contained cooler/freezer apparatus for carrying items in a frozen or refrigerated environment. The apparatus comprises a first insulated container which is divided into two portions: a first storage portion where items that are incompatible with a carbon dioxide environment are stored; and, a second portion for storing a solid coolant, namely, solid carbon dioxide or dry ice. The items are placed within a second nitrogen enriched container and this second container is placed within the first storage portion of the first insulated container. Within a short period of time, the dry ice starts to sublimate, thereby forming cold gaseous carbon dioxide which fills the volume of the apparatus. A fan is used to circulate the gaseous carbon dioxide throughout the insulated container thereby removing heat from the first portion and the heat conducted out of the nitrogen enriched container and rejecting it to the dry ice in the coolant compartment, thereby cooling the first portion of the insulated container and the nitrogen enriched container stowed therein. The cold gaseous carbon dioxide is circulated throughout the insulated container via gas ducts located within the walls of the insulated container. A thermostatic controller actuates the fan based upon temperature readings from thermocouples located within the nitrogen enriched container.

24 Claims, 4 Drawing Sheets

PORTABLE SELF-CONTAINED COOLER/FREEZER APPARATUS WITH NITROGEN ENVIRONMENT CONTAINER

BACKGROUND OF THE INVENTION

1. Field of the Invention

The present invention relates to a portable self-contained cooler/freezer apparatus, and more particularly, to a portable self-contained cooler/freezer apparatus which utilizes solid carbon dioxide in the form of blocks or snow to maintain a predetermined temperature within the apparatus and a pressurized nitrogen environment container within the apparatus to preserve certain perishable commodities.

2. Discussion of the Prior Art

Many shipping and trucking lines use refrigerated containers to carry perishable commodities over long distances. Typically, such a container is designed to carry either frozen foods or foods that must be maintained at higher, but still refrigerated temperatures, for example 40 degrees Fahrenheit. There exists a multitude of portable refrigeration devices designed to maintain or preserve perishable commodities at a given temperature for a given period of time. These refrigeration devices utilize various means to maintain the commodities at a given temperature, including compressed gas refrigeration systems, liquid cooled refrigeration systems, and solid cooled refrigeration systems.

An example of a refrigeration system employing compressed gas is set forth in U.S. Pat. No. 3,633,381. U.S. Pat. No. 3,633,381 discloses a portable refrigerator employing an open cycle system. A stored compressed gas, such as carbon dioxide, is passed from a storage container through an evaporator. The evaporator comprises a serpentine passageway for the gas in a surrounding medium such as water, which is maintained frozen due to the passage of the expanding compressed gas through the coiled passageway. The temperature of the evaporated medium is lower than the ambient temperature of the interior of the container comprising the storage portion of the refrigerator which is cooled thereby. The gas passing through the evaporator may be exhausted into the interior of the container whereby the cooler air which is next to the evaporator medium is circulated throughout the interior of the container.

U.S. Pat. No. 3,961,925 discloses a portable self-contained refrigerated storage and transportation container for preserving perishable commodities, and includes an insulated storage chamber for the perishable commodities. A recirculating liquid cooling system is provided within the container to maintain the desired temperature. The cooling system includes conduit and nozzle means disposed within the storage chamber and adapted to spray a liquid coolant, such as chilled brine, directly onto the perishable commodities to maintain them at a uniform cooled temperature. The sprayed liquid coolant is collected in the bottom portion of the storage chamber. A closed refrigeration system is also provided within the container and includes heat exchange means disposed within the bottom portion of the storage chamber for cooling the sprayed liquid coolant which has collected there.

In U.S. Pat. No. 4,502,293, there is disclosed a solid carbon dioxide cooling container. The container includes an insulated top, bottom, opposite sides and opposite end walls. An upstanding transverse insulated hollow housing is mounted within the container adjacent one end thereof and a carbon dioxide snow cabinet constructed from a "good" heat transfer material is disposed within the housing with opposing wall portions of the cabinet and housing passing exteriorly about the cabinet. A heat insulative horizontal baffle is mounted within the container spaced below the top wall and extends between the sidewalls thereof. The baffle defines a cooled air passage beneath the top wall extending lengthwise of the container. The airflow passage includes an outlet end adjacent and in at least reasonably closed communication with the end of the cooled air passage adjacent the aforementioned one container end wall and an inlet end opening outwardly of the housing into the interior of the container below the baffle. The end of the cooled air passage adjacent the other container end wall opens into the interior of the container and a thermostatically controllable air pump structure is provided to effect airflow inwardly of the inlet of the airflow passage, through the airflow passage and into the cooled air passage. In addition, a structure is provided for spray discharging of liquid carbon dioxide into the interior of the upper portion of the cabinet and into the airflow passage at points spaced in order to form carbon dioxide snow thereon.

U.S. Pat. Nos. 4,825,666, 4,991,402, and 5,125,237 all disclose transportable containers for carrying refrigerated products, however, each teaches the use of liquid $CO_2$ refrigerant contained in canisters that are located separately from the cargo area by perforated baffles, heat exchange tubes, and the like.

U.S. Pat. No. 4,276,752 discloses a refrigerated cargo container which utilizes solid carbon dioxide as a cooling medium. The refrigerated cargo container comprises a bunker which is filled with solid carbon dioxide or dry ice, a heat exchanger which is in thermal contact with the solid carbon dioxide, a fan, and ducts for circulating carbon dioxide gas through the container. Warm gas from the container's interior and the cargo contained therein rises to the top of the container due to the natural convective flow of gas in the container. This warm gas enters the heat exchanger and causes the solid carbon dioxide to sublime. As the coolant sublimes, the heat exchanger is cooled, and as warm gas passes over this cooled heat exchanger that gas is likewise cooled. A fan can be installed to increase the flow of warm gas from the interior of the container to the heat exchanger. A damper means is located in the duct carrying cold gas from the heat exchanger to control the amount of cool gas entering the container. A control means may also be installed to control the operation of the fans based on temperature differentials.

The above described patent utilizes natural convection of gas within the container in conjunction with a heat exchanger to provide a flow of cooling gas. A fan and damper means are utilized to augment air flow and partially control the circulation of the cooling gas. However, the use of a heat exchanger in direct contact with the dry ice causes pockets of carbon dioxide gas to form as the dry ice sublimates. These pockets create a large thermal resistance between the warmed gas and the dry ice heat sink, thereby limiting the heat rejection capability of the system. Limiting the heat rejection capability prevents the maintenance of lower temperatures within the cargo container. Additionally, in relying on natural convection, there is a diminished ability to accurately control and maintain the temperature within the container. Finally, the use of a heat exchanger adds unnecessary complication to the overall system.

The above described patents are representative of the various systems available for preserving perishable items. Each of these systems offers varying degrees of cooling capacity and temperature control. However, none of the above described systems alone offers a portable self-contained cooler/freezer apparatus which provides a high cooling capacity and a highly accurate temperature control system.

Additionally, none of the above-described patents describe a portable self-contained cooler/freezer apparatus having means for safely storing and preserving perishable items that are incompatible with a carbon dioxide environment. Many commodities are incompatible with gaseous carbon dioxide because they are alive and therefor respire, using stored chemical constituents from the air, to produce carbon dioxide and energy in the form of heat. This post-harvesting ripening process can cause spoilage during transportation.

SUMMARY OF THE INVENTION

Accordingly, it is an object of the instant invention is to provide a portable self-contained cooler/freezer apparatus that includes a shipping container for storing commodities in an environment which retards the spoilage due to the ripening effect.

It is another object of the instant invention to provide a portable self-contained cooler/freezer apparatus that includes a pressurized, nitrogen enriched shipping container which can safely store commodities which are incompatible with a gaseous carbon dioxide environment.

A further object is to provide the combination of a pressurized, nitrogen enriched shipping container for storing and shipping perishable commodities incompatible with a gaseous carbon dioxide environment and a first portable self-contained container, the combination including means for controlling the temperature of the nitrogen enriched container at predetermined refrigerated or below freezing levels.

The above advantages are achieved with a self-contained cooler/freezer apparatus having a nitrogen environment container installed therein for holding and preserving items which need to be stored at refrigerated or below freezing temperatures. The apparatus comprises a first insulated container having a coolant compartment therein for holding solid carbon dioxide, commonly referred to as dry ice, and a second compartment for holding a nitrogen enriched shipping container for storing perishable items in a nitrogen gas environment, and, a temperature control device for maintaining the temperature within the nitrogen enriched container at a predetermined value, typically, at refrigerated or below freezing temperatures. The storage compartment and the coolant compartment of the insulated container are thermally isolated from each other by an insulated shelf to prevent heat transfer therebetween. In addition, both the second storage compartment and the first coolant compartment of the first insulated container are unpressurized. However, one can design the apparatus utilizing pressurized compartments.

The temperature control device comprises at least one temperature sensing device, such as a thermocouple, and is mounted on a wall within the second nitrogen enriched container, a control device including a thermostatic controller for setting the desired temperature, and a device, such as a fan, for circulating gaseous carbon dioxide from the coolant compartment of the first insulated container to the second storage compartment holding the second nitrogen enriched container, and back to the coolant compartment. The gaseous carbon dioxide is formed by the sublimation of the dry ice contained within the coolant compartment. The circulating gaseous carbon dioxide absorbs the heat load of the storage compartment of the insulated container and rejects it to the dry ice contained within the coolant compartment. A pressure relief valve located in the storage compartment of the first insulated container vents carbon dioxide gas to the external environment when the pressure within the storage compartment of the first insulated container exceeds a predetermined safe threshold value.

The items to be shipped are loaded into the second nitrogen enriched container and a predetermined quantity of dry ice, in block or snow form, is loaded into the coolant compartment of the first insulated container. Within a short period of time, heat entering through the walls of the first insulated container is transferred to the dry ice thereby causing sublimation to occur and carbon dioxide gas to form. Given that the temperature at which sublimation occurs at one atmosphere pressure is approximately −109 degrees Fahrenheit, the dry ice contained within the coolant compartment will continuously generate a quantity of cold gaseous carbon dioxide. When needed, the cold gaseous carbon dioxide is circulated around the container via ducts in the sidewalls forming the first insulated container, thereby cooling the storage compartment of the first insulated container, and, the second nitrogen enriched container and the perishable items contained therein. The temperature within the storage compartment of the first insulated container is maintained at the predetermined value by the solid state control device. One or more thermocouples mounted on the interior walls of the second container monitor the temperature of the nitrogen environment and are connected to the solid state control device which is set to a predetermined temperature. When the temperature rises above the predetermined value, as measured by the thermocouples, the solid state control device actuates the fan which circulates the cold gaseous carbon dioxide around the first insulated container and thereby cools the exterior wall of the second container. The fan is stopped when the desired nitrogen environment temperature is achieved.

The self-contained cooler/freezer apparatus of the present invention utilizes a simple control system and the very high cooling capacity of dry ice, which is approximately 247 BTU/LB, to permit maintenance of desired product temperature over a wide range of external ambient temperatures for long periods of time. In utilizing dry ice as the coolant, temperatures ranging from sub-zero to 70 degrees Fahrenheit can be maintained for periods exceeding four days. A simplistic temperature control system circulates cold gaseous carbon dioxide, formed from the sublimation of the dry ice, as needed to accurately maintain the temperature within the insulated container and of the items contained therein at a constant, pre-set value. It is noted that for environmental conditions resulting in high heat loads to the items within the storage compartment of the insulated container, the fan duty cycle will be proportionately higher. The circulating gaseous carbon dioxide absorbs the heat from the storage compartment and rejects it to the dry ice in the coolant compartment causing increased sublimation to occur and creating additional gaseous carbon dioxide at a temperature of approximately of −109 degrees Fahrenheit.

The self-contained cooler/freezer apparatus of the present invention is designed in such a manner, and constructed from materials such that the apparatus is inexpensive to operate and environmentally safe. In addition, the materials used in the construction of both the first insulated container and the nitrogen enriched container of the apparatus are lightweight; accordingly, the apparatus can be utilized in applications requiring lightweight refrigeration/freezer units. Typical applications for the present invention are in the air freight, cargo ship or overland cross-country shipping of perishable commodities, vendor carts, hand-held ice chests, camping ice chests, or large stationary installations.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
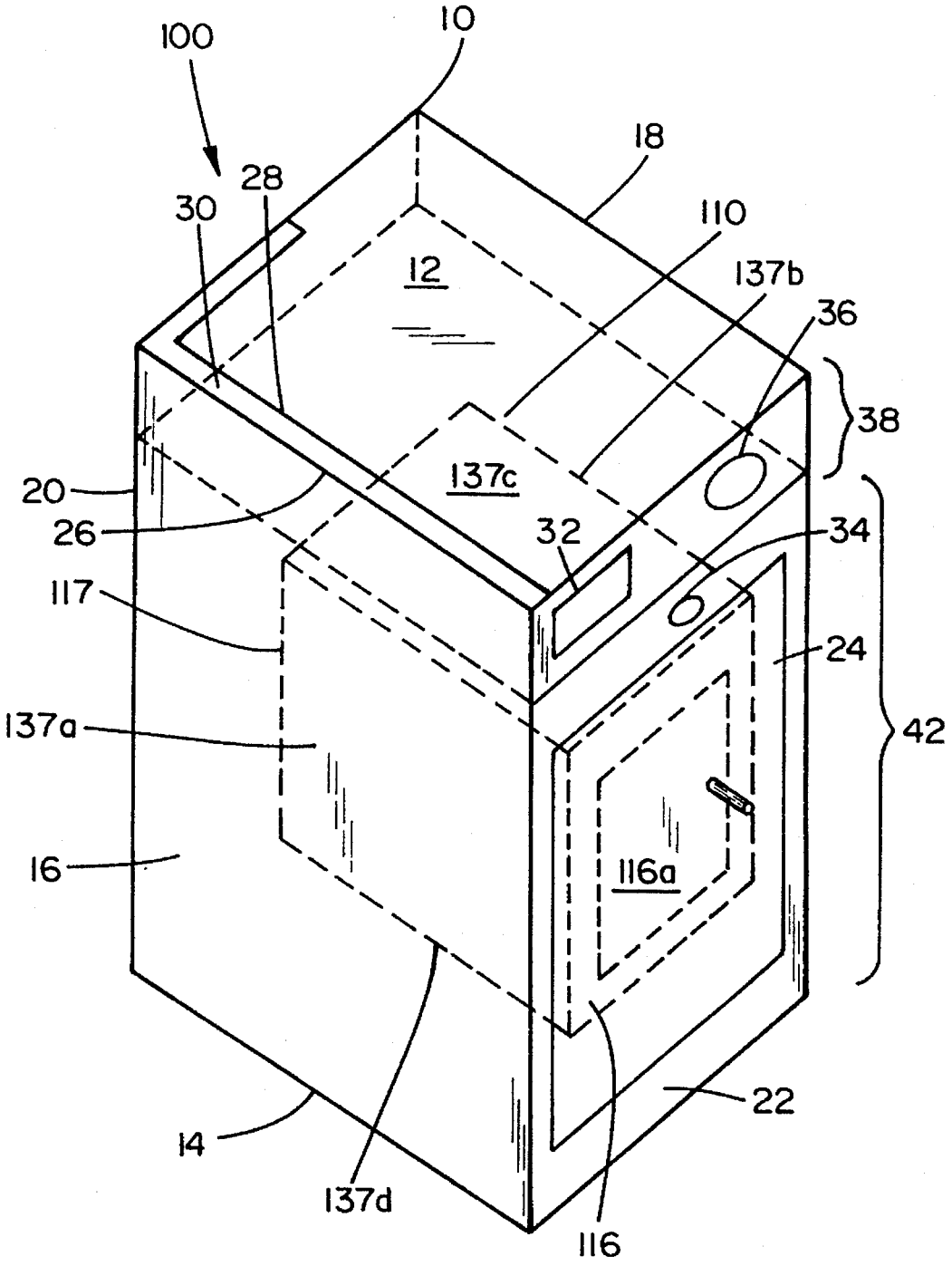
FIG. 1 is a diagrammatic representation of the self-contained cooler/freezer apparatus 100 including a broken-line drawing of the nitrogen environment container 110 of the present invention.

The present invention is directed to a self-contained cooler/freezer apparatus or container for holding and preserving items which need to be stored at refrigerated or below freezing temperatures, and, to the combination of a second nitrogen enriched container that is installed within the apparatus for holding and preserving certain perishable commodities. Referring to FIG. 1, there is shown a diagrammatic representation of the cooler/freezer apparatus 100 in which the nitrogen container is placed. The apparatus 100 comprises a first insulated container 10, rectangular in shape, having a top 12, a base 14, a pair of side walls 16 and 18, a rear wall 20, and a front wall 22 with an access door 24. The walls 16, 18, 20 and 22 as well as the top 12, base 14 and access door 24 are constructed from inner and outer hard shells 26 and 28 with a low conductivity insulating material 30 sandwiched therebetween. As shown in FIG. 1, a first portion or compartment 42 of the inner volume of the insulated container 10 can be utilized to store the items or products compatible with a gaseous carbon dioxide environment. In the embodiment of the instant invention, items or commodities that are not compatible with a gaseous carbon dioxide environment are stored in a separate nitrogen enriched container, generally indicated as container 110 in FIG. 1 and placed within the first portion 42 of the apparatus 100. As shown in FIG. 1, a second portion or compartment 38 of the apparatus 100, which is much smaller in volume than the first compartment, is a coolant compartment in which the material used as the refrigerant/coolant is stored. In addition, part of the temperature control means is also stored within the second portion 38 as will be explained in further detail below.

As shown in FIG. 1, mounted to the front wall 22, above the access door 24 is a compartment for holding a battery 32 which supplies power for operation of a solid state controller 36 which will monitor and control all fans, pressure relief valves, temperature and pressure sensors (to be explained in further detail below). Also mounted within the front wall 22 is a pressure relief valve 34 which vents the first portion of the inner volume. A detailed description of each of the components or elements mentioned above as well as a description of operation of the apparatus 100 and nitrogen environment container 110 is given in subsequent sections.

Figure 2:
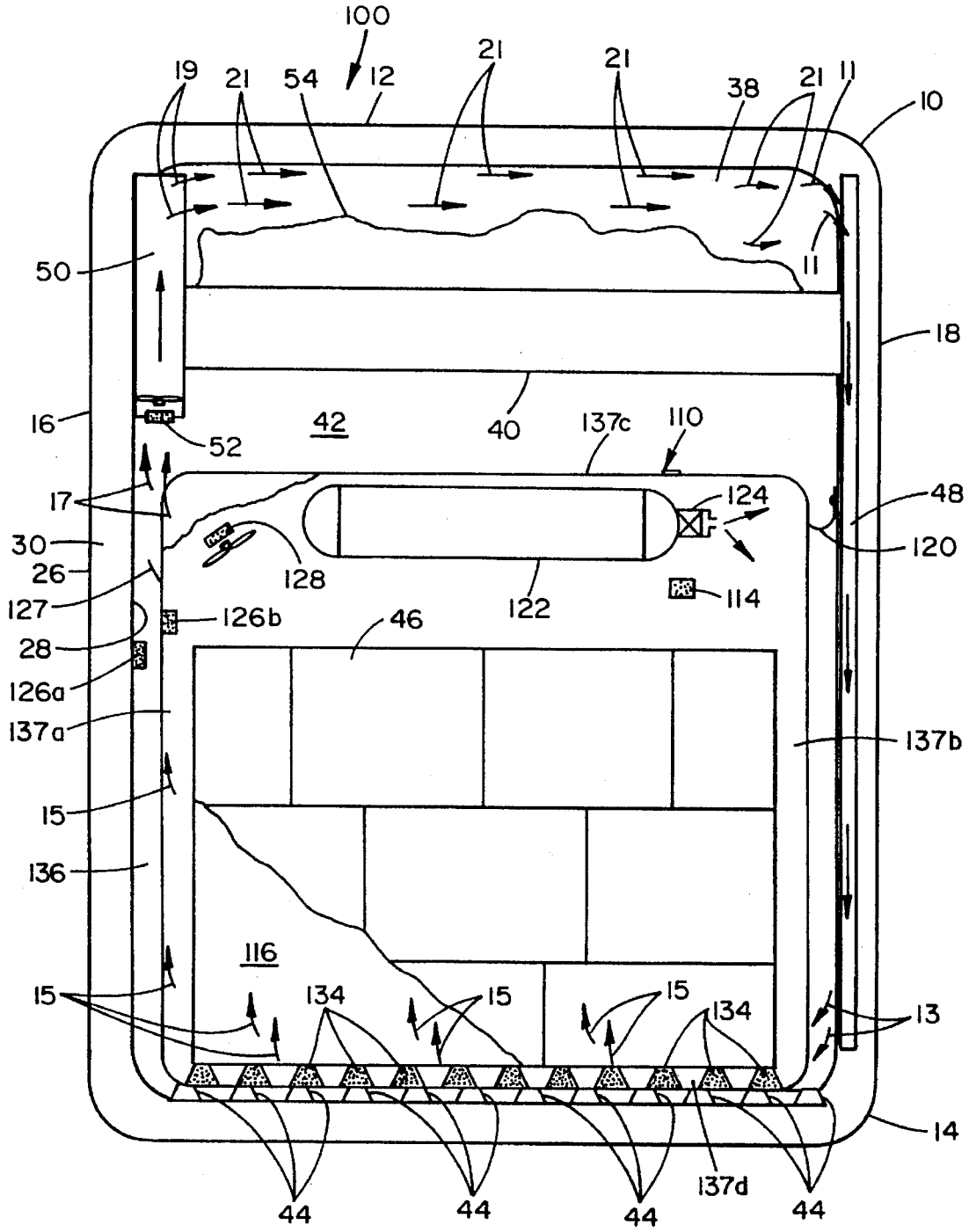
FIG. 2 is a predominantly exposed view of the internal structure of the nitrogen enriched container shown within the self-contained cooler/freezer apparatus of the present invention.

Turning to FIG. 2, there is shown a schematic view of the internal structure of the cooler/freezer apparatus 100 including the first insulated container 10 shown housing the nitrogen enriched container 110 for storing commodities incompatible with gaseous carbon dioxide. As discussed in the proceeding paragraph, the walls 16, 18, 20 and 22, the top 12, the base 14, and the access door 24 of first insulated container 10 are constructed from inner and outer hard shells 26 and 28 with a low conductivity insulating material 30 sandwiched therebetween. The inner and outer shells 26 and 28 are formed from any suitably rigid material, such as fiberglass, aluminum or stainless steel, which is capable of withstanding various structure loading. The insulating material 30 represents an important design choice in that heat energy transfer into or out of the insulated container 10 must be limited. Flexible or rigid insulation material, such as foamed organic plastics including polyurethane, polyethylene, and polystyrene, provides one such suitable design choice. Other materials will obviously suggest themselves to those skilled in the art. The coolant compartment 38 is formed by the placement of a shelf 40 as shown in FIG. 2, or, as will be discussed in detail below, a shelf 60 shown in FIG. 3, between the pair of sidewalls 16 and 18 and fit tightly between the rear wall 20 and the front wall 22. The shelf 40 (and 60) is formed from the same material as the walls 16, 18, 20 and 22, the top 12, the base 14, and the access door 24. It is essential that the shelf 40 (and 60) is insulated and that no gaps exist between the coolant compartment 38 and the first storage portion 42 of the insulated container 10. If the coolant compartment 38 is not fully thermally insulated from the first portion 42 of the insulated container 10, excessive heat transfer may occur between the two portions, thereby resulting in a loss of temperature control, especially at high end temperatures i.e., greater than 50 degrees Fahrenheit.

The base 14 of the first insulated container 10 comprises ridges 44 upon which the pressurized nitrogen enriched container 110 is placed. These ridges 44 allow for circulation of the coolant gas, which is carbon dioxide, thereby providing for better heat energy transfer. The inner shell 28 of each of the side walls 16 and 18 and the rear wall 20, is corrugated (not shown) so that the nitrogen gas container 110 is not placed directly against the side walls 16 and 18 or rear wall 20, thereby allowing for the free circulation of carbon dioxide gas between the walls 16, 18 and 20 and the nitrogen gas container 110. In one side wall 18, a gas duct 48 is positioned within the insulation 30 and directly behind the inner shell 28. The gas duct 48 runs almost the entire length of the side wall 18, extending from the coolant compartment 38 to the bottom of the first portion 42 of the insulated container 10. At the upper end of the gas duct 48 is a vent or opening through which cold gaseous carbon dioxide in combination with nitrogen gas, as will be explained in detail below, indicated by the arrows 11, enters for transport to the first portion 42 of the insulated container 10. At the lower end of the gas duct 48 is a second vent or opening through which the cold gaseous carbon dioxide and nitrogen gas exits, indicated by the arrows 13, and circulates through the first portion 42 of the insulated container 10 and around all outer surfaces of the pressurized nitrogen enriched container 110 as indicated by the arrows 15. The cold gaseous carbon dioxide circulates through the first storage portion 42 to maintain the temperature of the commodities 46 within the second container 110 at the desired value. As the carbon dioxide gas circulates around the first portion and around the nitrogen enriched container, it absorbs heat energy. One or several gas ducts can be placed within the side wall 18. The number of gas ducts and the size of the gas duct(s) can vary and is basically an engineering choice based on container size and design heat loads. In the other side wall 16, as shown in FIG. 2, a second gas duct 50 is positioned within the insulation 30 and directly behind the inner shell 28. This gas duct 50 is much shorter in length than the other gas duct 48, extending from the coolant compartment 38 to just inside the first portion 42 of the insulated container 10. At the lower end of the gas duct 50 is an opening in which dual fans 52 are mounted. It should be noted that only a single fan can be utilized just as effectively as two. The suction end of the dual fans 52 are directed towards the first portion 42 of the insulated container 10. The dual suction fans 52 serve two purposes. One purpose is to draw in the circulating warmer gaseous carbon dioxide and any nitrogen gas vented out of the nitrogen enriched container and in the first portion 42 of the insulated container 10, indicated by the arrows 17, and direct it through the gas duct 50 and out through a vent in the upper portion of the gas duct 50 into the coolant compartment 38, as indicated by the arrows 19. The second purpose is to circulate the cold gaseous carbon dioxide formed by the sublimation of dry ice 54, placed within the coolant compartment 38, and any residual nitrogen gas, into the first portion 42 of the insulated container 10 via the gas duct 48 in order to lower the temperature within the first portion 42 of the insulated container 10 and within the nitrogen container 110. The warmer gaseous carbon dioxide drawn in from the first portion 42 of the container 10 is cooled in two ways. First, as it passes over the dry ice 54 as indicated by the arrows 21, and secondly, as it mixes with the sublimated gas continuously being generated in the coolant compartment 38. The dual fans 52 are powered by the high energy battery 32 shown in FIG. 1, and are controlled by the solid state controller 36 which is powered by the high energy battery 32.

The nitrogen enriched container 110 is essentially configured to be insertable within the access door 24 of insulated container 10. As shown in FIG. 1, the container 110 comprises six walls: a front wall 116 having an access door **116*a* so that perishable items may be placed therein, a back wall 117, side walls 137*a*, 137*b*, a top wall 137*c*, and a base wall 137*d*. Preferably, the walls are thin and uninsulated to provide adequate heat transfer so that the desired temperatures within the container may be maintained. The walls of the nitrogen enriched container 110 may be made of fiberglass, aluminum or stainless steel, though other types of materials may be used. The base wall 137*d* comprises ridges 134 upon which the perishable items or commodities 46 are placed. These ridges 134 allow for more effective circulation of the cooled nitrogen gas within the container 110. Although not shown in FIG. 2, ridges may be formed in inner sidewalls (not shown) of the nitrogen enriched container 110 so that items 46** are not placed directly against the container walls. Items that are placed directly against container walls may be subject to excessive cooling.

In operation, dry ice 54, in either block or snow form, is loaded into the fully insulated coolant compartment 38. Dry ice has an extremely high cooling capacity on the order of 247 BTU/LB; accordingly, the dry ice 54 provides a highly weight-efficient heat sink. Once the desired temperature and the weight of the nitrogen gas container containing the perishable commodities is known, then the required amount of dry ice can be calculated as a function of its own cooling capacity. Factors such as the size of the insulated container, the thermal resistance of the insulation provided in the container walls, the temperature of the environment that the shipping container is to be transported and the temperature desired to be maintained within the insulated container, and, the amount of time it takes to transport the goods in the nitrogen environment to a particular destination must be taken into account when calculating the amount of dry ice to be provided in the coolant compartment. This is because the rate of heat conduction through any material, including insulation, is directly proportional to the difference in temperature on either side of the material or insulation and the area normal to the direction of heat flow in the manner governed by equation (1) as follows:

$$q=kA/L(t_2-t) \quad (1)$$

where "q" is equal to the steady state rate of heat flow having units of BTU/hr, "k" is equal to the thermal conductivity of the wall and of the particular insulation material, "A" is the total area normal to the heat flow, "L" is the thickness of the material and, $t_2 - t_1$ represents the temperature difference between the outside of the container ($t_2$) and the inside of the container ($t_1$). It is easily understood from equation 1 that the term L/kA represents the resistance to heat transfer.

Additionally, a sufficient amount of dry ice surface area must be left exposed for sufficient forced convection heat transfer to occur from the internal gaseous carbon dioxide environment; namely, the warm gaseous carbon dioxide drawn from the first portion 42 of the insulated container 10.

The nitrogen gas container 110 carrying goods incompatible with gaseous carbon dioxide to be shipped is then loaded into the first portion 42 of the insulated container 10. Within a short period of time heat energy is transferred into the insulated container from the ambient environment when the access door 24 is open to load the nitrogen gas container, and, from the heat generated by the items contained in the nitrogen gas container 110 and transferred to the exterior of the container thereby causing sublimation of the dry ice 54 within the coolant compartment 38. Given that the temperature at which sublimation occurs at one atmosphere pressure at the surface of the dry ice 54 is approximately −109 degrees Fahrenheit, the coolant compartment 38 contains a quantity of cold, approximately −109 degrees Fahrenheit, gaseous carbon dioxide generated as described in detail below. When the thermostatically controlled dual fans 52 are actuated, the cold gas is circulated to and throughout the first portion 42 of the insulated container 10 via gas ducts 48 and 50 to maintain the temperature within the nitrogen container 110 at the desired level. As a precautionary measure, the pressure relief valve 34 (shown in FIG. 1) which is connected to the first portion 42 of the insulated container 10 will actuate or open to the ambient environment when the $CO_2$ pressure within the first portion 42 of the insulated container 10 rises above a predetermined level, for example 1 psig. The pressure relief valve 34 is connected to the first portion 42 of the insulated container 10 as opposed to the coolant compartment 38 because it is more beneficial from an energy standpoint to vent warmer gaseous carbon dioxide into the external environment than it is to vent cold gaseous carbon dioxide.

As shown in FIG. 2, circulation of the cold gaseous dioxide is caused by the operation of the dual fans 52 mounted in the lower portion of the gas duct 50. Each fan is operable to supply a sufficient flow rate of gaseous carbon dioxide and any gaseous nitrogen that escapes the nitrogen container 110 through pressure release valve 127 as will be described hereinbelow. The dual fans 52 must create an airflow velocity sufficient to reject the heat energy within the first portion 42 of the insulated container.10 to the dry ice 54 in order to maintain the desired temperature within the nitrogen container 110. However, there exists a tradeoff between more accurate control of the temperature and achieving lower temperatures. The lower the capacity of the dual fans 52, the more uniform the temperature profile within the first portion 42 of the insulated container 10, whereas the higher the capacity of the dual fans 52 the lower the temperatures. This is easily explained in that the lower the capacity of the dual fans 52, the longer the fans will be on during any cooling cycle. During periods in which the fans are activated, better mixing of the carbon dioxide in the first portion 42 of the insulated container 10 results in small temperature gradients within the first portion 42 of the insulated container 10. Variable speed fans can be employed to achieve both the desirable results of minimum first portion temperature gradients as well as lower first portion 42 temperature level control.

Figure 3:
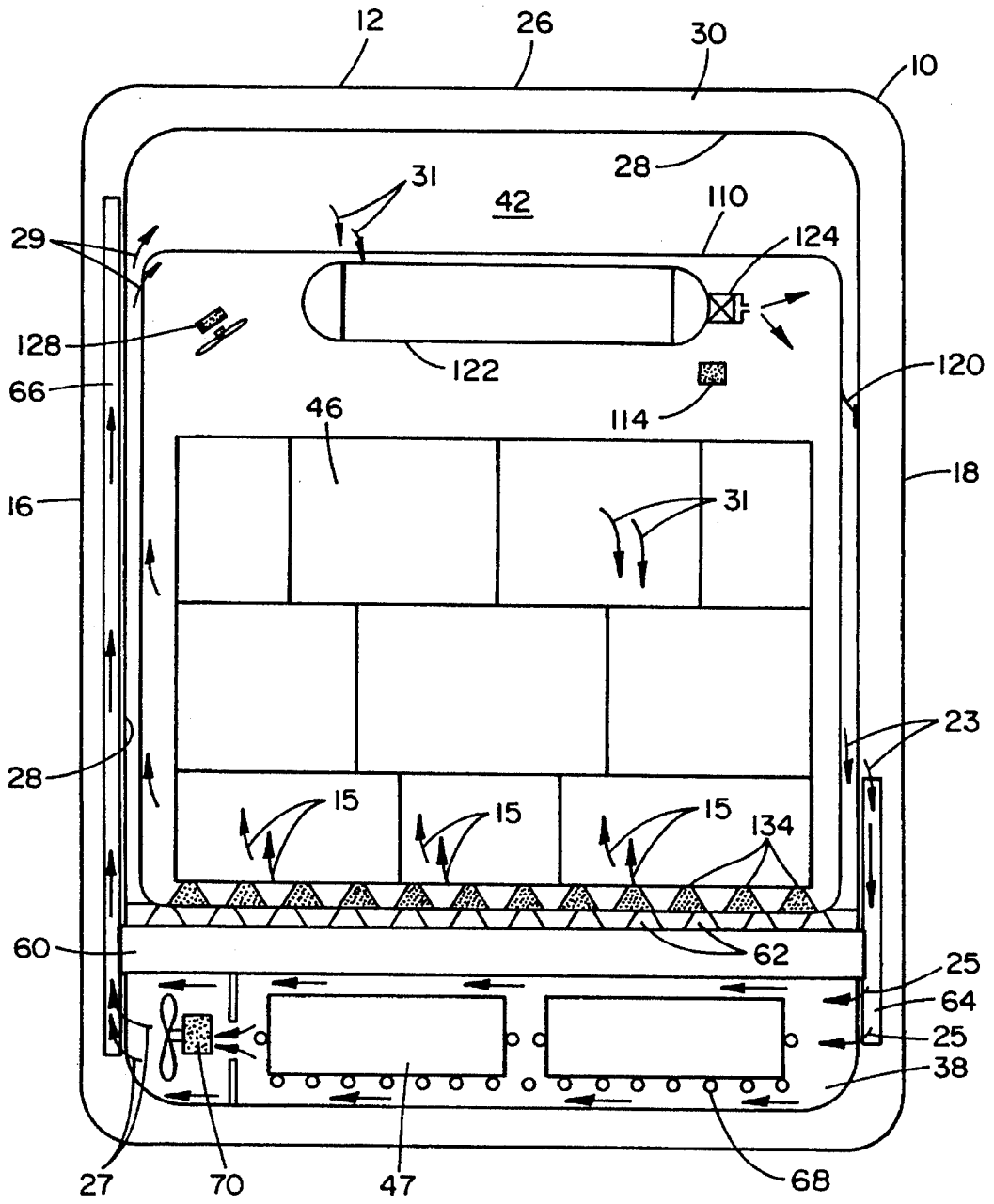
FIG. 3 is a schematic view of an alternate embodiment of the internal structure of the self-contained cooler/freezer apparatus of the present invention including an exposed view of the nitrogen enriched container.

The dual fans 52 are controlled by the solid state controller 36 (shown in FIG. 1). Thermocouple 114 is mounted on a wall 116 of the nitrogen container 110 as shown in FIG. 2. When utilized in this manner, the thermocouple 114 is used as a measure of the average radiant and convective environment within the nitrogen environment container 110 and generates an electrical signal proportional to this temperature. The electrical signals are supplied to the solid state controller 36 via electrical connectors 120, as shown in FIGS. 2 and 3, wherein a comparison is made between the electrical signals and the predetermined temperature setting. If the temperature within the nitrogen container 110 is above the preset level, the dual fans 52 are activated and cold gaseous carbon dioxide is circulated through the first portion 42 of the insulated container 10 thereby reducing the temperature therein. If on the other hand, the temperature is below the preset level, the dual fans 52 remain idle. It is possible that one or more thermocouples may be provided within the nitrogen container 110 of the apparatus 100 to thereby more closely reflect the actual item temperature within the container 110. It is also noted that thermocouples (not shown) exposed to the cool carbon dioxide environment in the first portion 42 of the container 10 could also be used. When the temperature controller 36 receives signals from a thermocouple 114 indicating temperature within the nitrogen container 110 is above a preset level, then the dual fans will be activated by the controller to create the flow of cool carbon dioxide to the first portion 42 until the temperature of the system is equalized to a preset temperature at which time the dual fans remain idle.

Nitrogen gas is supplied within the nitrogen container 110 by a tank 122 of compressed or pressurized nitrogen. As mentioned above, nitrogen gas within the nitrogen container 110 is maintained at a pressure that is greater than the pressure of the cool carbon dioxide gas outside the container. Solenoid valve 124 is periodically actuated via electrical connectors 120 as shown in FIG. 2, to provide a controlled release of pressurized nitrogen gas from tank 122. Suitable pressure sensing devices **126*a,b* are provided to monitor the pressures within the first insulated container 100 and nitrogen environment container 110, respectively. These pressure sensors 126*a,b* are connected to the solid state controller 36 (shown in FIG. 1) which compares the values of the pressures detected by pressure sensors 126*a,b* within the respective containers and initiates a control signal to activate solenoid valve 124 to release nitrogen to maintain a net positive pressure of nitrogen gas within container 110 with respect to the pressure of carbon dioxide in the first insulated container. In this way, it is assured that carbon dioxide will not enter the nitrogen container thus decreasing the likelihood of commodity spoilage, especially if the gaseous carbon dioxide environment of the first portion of the insulated container is desired to be pressurized. As shown in FIG. 2, a fan 128 is provided within the pressurized nitrogen gas container 110 that is periodically activated to maintain uniform temperature and humidity conditions within the nitrogen enriched container 110. This fan may be operated by a programmed timer (not shown) or by electrical impulse from the pressure controller 36*a***.

Figure 4:
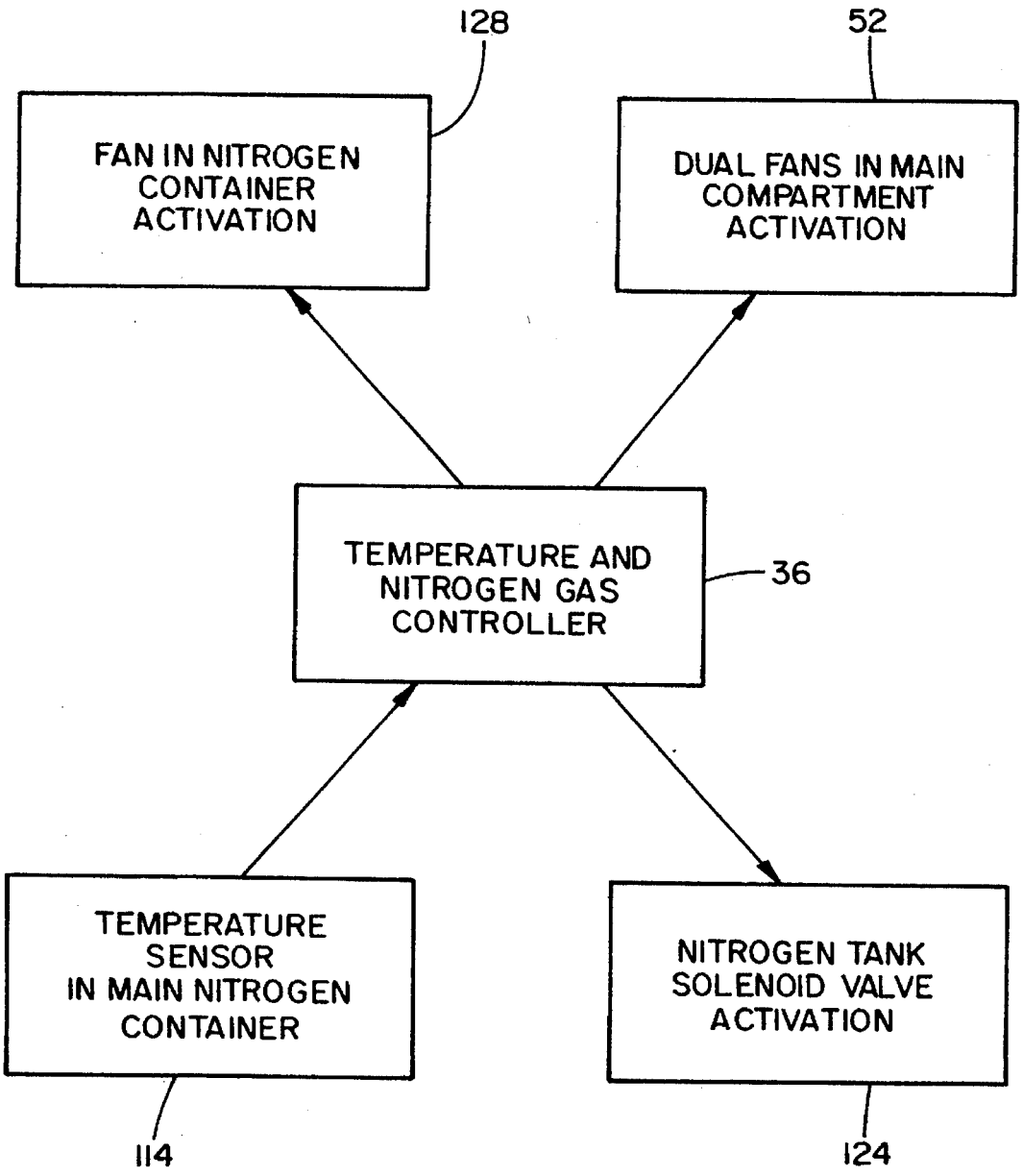
FIG. 4 is a conceptual block diagram illustrating the operation of the solid state control device 36.

It is understood from the view of FIG. 2 that all electrical connections between the solid state control device 36 and the pressure and temperature sensing devices are provided via electrical connector 120. When the nitrogen container is placed in the insulated container, the electrical connector 120 extending from the nitrogen container is connected with an appropriate mating connector (not shown) located on an inner wall of the insulated container to complete all electrical connections from the sensing devices 114, **126*a,b*, the nitrogen container fan 128, and the nitrogen tank solenoid activation 124, to the control device 36. This is illustrated conceptually in the block diagram of FIG. 4**.

The nitrogen gas container is also provided with a nitrogen vent valve 127 to vent nitrogen gas out of container 110 if the pressure within container 110 rises above a preset level, for example, 2 psig, with respect to the pressure of the cool COD within the first portion of the container. The vent 127 is provided in one wall **137*a* of container 110**, but, it is understood that the nitrogen release vent may be in any wall of the container.

The simple controls featured in this design, together with the high cooling capacity of dry ice permits the maintenance of desired product temperatures, for example, sub-zero temperatures, –40 degrees Fahrenheit, up to 70 degrees Fahrenheit for many days of transport over a wide range or external ambient temperatures.

Referring to FIG. 3, there is shown a schematic view of an alternate embodiment of the internal structure of the cooler/freezer apparatus 100. As in the embodiment of FIG. 2, the walls 16, 18, 20 and 22, the top 12, the base 14, and the access door 24 of insulated container 10 are constructed from inner and outer hard shells 26 and 28 with a high resistance insulating material 30 sandwiched therebetween. The coolant compartment 38, however, is placed at the bottom portion of the insulated container 10, whereas in the previous embodiment, the coolant compartment 38 is placed in the upper portion of the insulated container 10. The coolant compartment 38 is formed by the placement of a shelf 60 between the pair of sidewalls 16 and 18 and fit tightly between the rear wall 20 and the front wall 22. Once again the shelf 60 is formed from the same materials as the walls 16, 18, 20 and 22, the top 12, the base 14, and the access door 24; however, the top of the shelf 60 comprises ridges 62 upon which the nitrogen gas container 110 containing the items 46 is placed. These ridges 62 serve the same purpose as ridges 44 in the previous embodiment; namely, to provide gaps for circulation of the gaseous carbon dioxide.

In one side wall 18, a gas duct 64 is positioned within the insulation 30 and directly behind the inner shell 28. The gas duct 64 runs a short length of the side wall 18, extending from the bottom of the first portion 42 of the insulated container 10 to the coolant compartment 38. At the upper end of the gas duct 64 is a vent or opening through which warmer gaseous carbon dioxide from the first portion 42 of the insulated container 10, indicated by the arrows 23, enters for transport to the coolant compartment 38. At the lower end of the gas duct 64 is a second vent or opening through which the warmer gaseous carbon dioxide exits into the coolant compartment 38, indicated by the arrows 25. In the other side wall 16, a second gas duct 66 is positioned within the insulation 30 and directly behind the inner shell 28. This second gas duct 66 runs the entire length of the side wall 16. At the lower end of the gas duct 66 is a vent or opening in which cold gaseous carbon dioxide exits the coolant compartment 38, indicated by the arrows 27, for transport to the first portion 42 of the insulated container 10. At the upper end of the gas duct 66 is a second vent or opening through which the cold gaseous carbon dioxide exits, indicated by the arrows 29, and circulates around the outer surfaces of the nitrogen container 110 and throughout the first portion 42 of the insulated container 10 absorbing heat energy.

As shown in FIG. 3, the coolant compartment 38 can hold dry ice in snow form or in block form 47 on a support shelf 68. The support shelf 68 can be formed from any material capable of supporting heavy loads. A fan 70 mounted within the coolant compartment 38 draws cold gaseous carbon dioxide formed by the mixing of warmer gaseous carbon dioxide and escaped nitrogen gas from the nitrogen container 110 that is drawn in from the first portion 42 of the insulated container 10 with the continuously sublimated gaseous carbon dioxide, and expels it into the gas duct 66 where it is circulated into the first portion 42 of the insulated container 10. Since carbon dioxide is a heavier gas, it naturally circulates within the first portion 42 of the insulated container 10 in a downward direction as indicated by the arrows 31. The basic operation of the apparatus 100 is substantially identical to that as previously described in relation to the device shown in FIG. 2.

Although shown and described is what are believed to be the most practical and preferred embodiments, it is apparatus that departures from specific methods and designs described and shown will suggest themselves to those skilled in the art and may be used without departing from the spirit and scope of the invention. The present invention is not restricted to the particular constructions described and illustrated, but should be constructed to cohere with all modifications that may fall within the scope of the appended claims.

What is claimed is:

1. A self-contained cooler/freezer apparatus for holding and preserving items which need to be stored at refrigerated or frozen temperatures, said apparatus comprising:

(a) a first insulated container having a first storage compartment and a second coolanat compartment insulated from said first storage compartment for holding cargon dioxide in solid form, a first gas passageway connecting said second coolant compartment to said first storage compartment, a second gas passageway connecting said first storage compartment to said second coolant compartment;

(b) a second container having an enclosed environment for storing said items therin, said second container placed in said first storage compartment of said first insulated container;

(c) at least one temperature sensing device mounted within said apparatus for sensing current temperatures within said second container;

(d) means of circulating gaseous carbon dioxide fromed by the sublimation or said solid carbon dioxide to said first storage compartment from said second coolant compartment, and (e) control means for maintaing the temperture within said first storage compartment and said second container at a predetermined value, said control means including means for determining the difference between a courrent sensed temperature of said apparatus with said predetermined temperature value and enabling said circulating means to circulate an amount of said gaseous carbon dioxide in accordance with said temperature difference.

2. The self-contained cooler/freezer apparatus according to claim 1 wherein each said temperature sensing device is mounted within said second container for communicating the temperature of said apparatus to said control means.

3. The self-contained cooler/freezer apparatus according to claim 1 wherein said second container includes a nitrogen gas tank for supplying nitrogen gas at a predetermined pressure within said second container.

4. The self-contained cooler/freezer apparatus according to claim 3, wherein said second container includes a nitrogen release vent for allowing nitrogen gas to escape to within the first storage compartment of said first insulated container when the pressure of said nitrogen gas rises above a predetermined level.

5. The self-contained cooler/freezer apparatus according to claim 3 wherein said second container includes a solenoid valve for providing controlled release of said nitrogen gas from said nitrogen gas tank.

6. The self-contained cooler/freezer apparatus according to claim 3 wherein said second container includes means for equalizing the temperature within said second container.

7. The self-contained cooler/freezer apparatus according to claim 6 wherein said means for equalizing the temperature within said second container includes at least one fan means for circulating said nitrogen gas within said second container.

8. The self-contained cooler/freezer apparatus according to claim 1 wherein said first insulated container being substantially rectangular in shape comprises first and second side walls, a pair of end walls, one of said pair of end walls having said access doorway and door mounted therein, a top, and a base, said first and second side walls, said pair of end walls, said top, and said base each being formed from an inner and outer shell with an insulative material sandwiched therebetween.

9. The self-contained cooler/freezer apparatus according to claim 8, wherein said second container comprises first and second side walls, a pair of end walls, one of said pair of end walls having a door mounted therein, a top, and a base, said first and second side walls, said pair of end walls, said top, and said base each being formed of non-insulating material.

10. The self-contained cooler/freezer apparatus according to claim 9 wherein said first and second side walls, said pair of end walls, said top, and said base of said second container are made of aluminum.

11. The self-contained cooler/freezer apparatus according to claim 9 wherein said first and second side walls, said pair of end walls, said top, and said base of said second container are made of stainless steel.

12. The self-contained cooler/freezer apparatus according to calim 8, wherein said first side wall of said first insulated contaner comprises said first gas passageway, having vents at each end thereof, mounted therein and extending from said second coolant compartment to said base of said first insulated container, and said second side wall of said first insulated container comprises said second gas passageway, having vents at each end thereof, mounted therein and extending from said second coolant compartment to just inside said first storage compartment of said first insulated container, said second gas passageway having said means for circulating mounted therein, said first and second gas passageways being operable to circulate said gaseous carbon dioxide.

13. The self-contained cooler/freezer apparatus according to claim 9, wherein said inner shells of said first and second side walls of said first container comprise corrugations for providing increased circulation of said gaseous carbon dioxide.

14. The self-contained cooler/freezer apparatus according to claim 9, wherein said second coolant compartment is formed by the mounting of a shelf between said first and second side walls in the upper region of said first container, said shelf being constructed from an inner and outer shell with an insulative material sandwiched therebetween.

15. The self-contained cooler/freezer apparatus according to claim 14, wherein said control means includes a thermostatic controller for setting said temperature of said apparatus to said predetermined value, said thermostatic controller responsive to a said one temperature sensing device and operable to control said means for circulating.

16. The self-contained cooler/freezer apparatus according to claim 15, wherein said at least one temperature sensing device is a thermocouple, said thermocouple is disposed within a heat conductive material for providing a thermal inertia thereby more closely reflecting the temperature of said items placed in said second container.

17. The self-contained cooler/freezer apparatus according to claim 15, wherein said means for circulating comprises at least one fan operable to circulate said gaseous carbon dioxide at a predetermined rate.

18. The self-contained cooler/freezer apparatus according to claim 17, further comprising a battery for supplying power to said at least one fan and said thermostatic controller.

19. The self-contained cooler/freezer apparatus according to claim 9, wherein said base of said first container comprises ridges formed on its inner shell for providing increased circulation of said gaseous carbon dioxide within said first storage compartment and around outside surfaces of said walls of said second container.

20. The self-contained cooler/freezer apparatus according to claim 1 wherein said temperature sensing device is mounted on one of said pair of end walls within said second container.

21. A method for holding and preserving items which need to be stored at refrigerated or frozen temperatures, said method comprising the steps of:

(a) loading solid carbon dioxide into a first insulated container having a first storage compartment and a second coolant compartment, said solid carbon dioxide being loaded into said second coolant compartment;

(b) positioning said items within a second container having a nitrogen environment;

(c) loading second container within said first storage compartment of said first insulated container; and (d) controlling and maintaing the temperture within said first storage compartment of said first insulated container and within said second container by circulating gaseous carbon dioxide formed by the sublimation of said solid carbon dioxide throughout said first insulated container and around said second container.

22. The method for holding and preserving items according to claim 21, wherein said step of controlling and maintaining the temperature comprises the steps of:

(a) measuring the temperature within said second container;

(b) comparing the measured temperature with a predetermined temperature value; and (c) actuating at least one fan to circulate said sublimed gaseous carbon dioxide if the temperature within said second container is above said predetermined temperature.

23. The method for holding and preserving items according to claim 22, wherein said at least one fan draws in warmer gaseous carbon dioxide from said first storage compartment of said first insulated container and forces it to pass over said solid carbon dioxide thereby cooling said carbon dioxide gas and mixing it with said sublimed gaseous carbon dioxide for circulation into said first storage compartment first insulated container and around said second container.

24. The method for holding and preserving items according to claim 22, wherein said at least one fan draws sublimed gaseous carbon dioxide from said second coolant compartment and circulates it to said first storage compartment of said first insulated container and forces warmer gaseous carbon dioxide within said first storage compartment of said first insulated container to pass over said solid carbon dioxide thereby cooling it and mixing it with said sublimed gaseous carbon dioxide.

* * * * *